US009979141B2

(12) United States Patent
Yasuda et al.

(10) Patent No.: US 9,979,141 B2
(45) Date of Patent: May 22, 2018

(54) PLUG CONNECTOR AND POWER CIRCUIT CUT-OFF DEVICE

(71) Applicant: Yazaki Corporation, Tokyo (JP)

(72) Inventors: Kenta Yasuda, Shizuoka (JP); Masaaki Iwabe, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/596,902

(22) Filed: May 16, 2017

(65) Prior Publication Data

US 2017/0338604 A1 Nov. 23, 2017

(30) Foreign Application Priority Data

May 20, 2016 (JP) ..... 2016-101839

(51) Int. Cl.
*H01R 13/703* (2006.01)
*H01R 13/05* (2006.01)
*H01R 13/66* (2006.01)

(52) U.S. Cl.
CPC ..... *H01R 13/7031* (2013.01); *H01R 13/05* (2013.01); *H01R 13/665* (2013.01)

(58) Field of Classification Search
CPC ... H01R 13/7031; H01R 13/05; H01R 13/665
USPC ..... 439/620.21
See application file for complete search history.

(56) References Cited

U.S. PATENT DOCUMENTS 6,007,352 A * 12/1999 Azuma ..... H01R 23/6873 439/108
6,471,543 B1 * 10/2002 Balcombe ..... H01R 13/745 439/362
6,671,145 B2 * 12/2003 Germain ..... H01H 83/04 335/24
7,520,751 B2 * 4/2009 Kim ..... H01R 13/7035 200/51 R
7,914,344 B2 * 3/2011 Tin ..... H01R 13/64 439/668
8,550,840 B2 * 10/2013 Mann ..... H01R 13/7031 439/489
9,548,574 B2 * 1/2017 Hsu ..... H01R 13/7038
2003/0151478 A1 * 8/2003 Radosavljevic ..... H01H 71/20 335/18
2009/0253295 A1 * 10/2009 Kameyama ..... H01R 13/65802 439/607.27
2010/0105226 A1 * 4/2010 Gong ..... H01R 13/64 439/135
2014/0213087 A1 7/2014 Furuya et al.

FOREIGN PATENT DOCUMENTS

JP 2014-146451 A 8/2014

* cited by examiner

*Primary Examiner* — Alexander Gilman
(74) *Attorney, Agent, or Firm* — Kenealy Vaidya LLP

(57) ABSTRACT

A plug connector is provided in a plug housing and has a conductive braided wire that connects ends of a plurality of plug terminals opposite to contact points with receptacle terminals such that each plug terminal can move relatively to each other. A service plug has a plug connector and a receptacle connector.

6 Claims, 7 Drawing Sheets

PLUG CONNECTOR AND POWER CIRCUIT CUT-OFF DEVICE

CROSS-REFERENCE TO RELATED APPLICATION(S)

The present application claims priority to and incorporates by reference the entire contents of Japanese Patent Application No. 2016-101839 filed in Japan on May 20, 2016.

BACKGROUND OF THE INVENTION

1. Field of the Invention

The present invention relates to a plug connector and a power circuit cut-off device.

2. Description of the Related Art

In the background art, a power circuit cut-off device (service plug) is usually mounted on a vehicle such as an electric vehicle, a fuel cell vehicle, and a hybrid vehicle and is integrated into a power circuit for supplying electric power from a power source such as a battery to a load such as a rotary electric machine to electrically connect or disconnect the power circuit as necessary (for example, Japanese Patent Application Laid-open No. 2014-146451). The power circuit cut-off device has a plug connector and a receptacle connector. As the plug connector is engaged with the receptacle connector, the power circuit is electrically connected. As the plug connector is disengaged from the receptacle connector, the power circuit is electrically disconnected.

However, there is a demand for further improvement of the power circuit cut-off device to allow smooth insertion and removal between a terminal of the plug connector and a terminal of the receptacle connector when the plug connector is engaged with or disengaged from the receptacle connector.

SUMMARY OF THE INVENTION

In view of the aforementioned problems, the present invention is to provide a plug connector and a power circuit cut-off device capable of smooth insertion and removal between the terminal of the plug connector and the terminal of the receptacle connector.

In order to solve the above mentioned problem and achieve the object, a plug connector according to one aspect of the present invention includes a housing engaged with or disengaged from a receptacle connector for performing electrical connection; and a plug terminal unit that is provided in the housing, and has a plurality of bar-shaped plug terminals inserted into or removed from receptacle terminals of the receptacle connector in an axial direction, and a conductive wire member that connects ends of the plurality of plug terminals opposite to contact points with the receptacle terminals such that each plug terminal can move relatively to each other, wherein the plurality of plug terminals and the wire member constitute a part of a power circuit for supplying electric power from a power source to a load along with the receptacle terminals, and the plurality of plug terminals electrically conduct the power circuit while the plug terminals are connected to the receptacle terminals.

According to another aspect of the present invention, in the plug connector, it is preferable that the wire member is a braided wire formed by braiding a plurality of metal wires or a spring stack formed by stacking a plurality of metal plates.

According to still another aspect of the present invention, in the plug connector, it is preferable that the plug terminal unit has a fastening member configured to fasten the ends opposite to contact points with the receptacle terminals to the wire member, a head portion of the fastening member is formed in a spherical surface shape, and the head portion of the fastening member abuts on an inside of the housing when the plug terminals are inserted into the receptacle terminals.

According to still another aspect of the present invention, a power circuit cut-off device includes a receptacle connector having a receptacle terminal for performing electrical connection; and a plug connector having a housing engaged with or disengaged with the receptacle connector, and a plug terminal unit that is provided in the housing and has a plurality of bar-shaped plug terminals inserted into or removed from receptacle terminals of the receptacle connector in an axial direction, and a conductive wire member that connects ends of the plurality of plug terminals opposite to contact points with the receptacle terminals such that each plug terminal can move relatively to each other, wherein the plurality of plug terminals and the wire member constitute a part of a power circuit for supplying electric power from a power source to a load along with the receptacle terminals, and the plurality of plug terminals electrically conduct the power circuit while the plug terminals are connected to the receptacle terminals.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Aspects (embodiments) for embodying the present invention will be described in details with reference to the accompanying drawings. The present invention is not limited by the contents described in the following embodiments. In addition, elements described below include those readily conceived by a person ordinarily skilled in the art and those substantially equivalent thereto. In addition, the configurations described below may be appropriately combined. Furthermore, various omissions, substitutions, or changes for the configurations may be possible without departing from the scope and spirit of the present invention.

Embodiment

Figure 1:
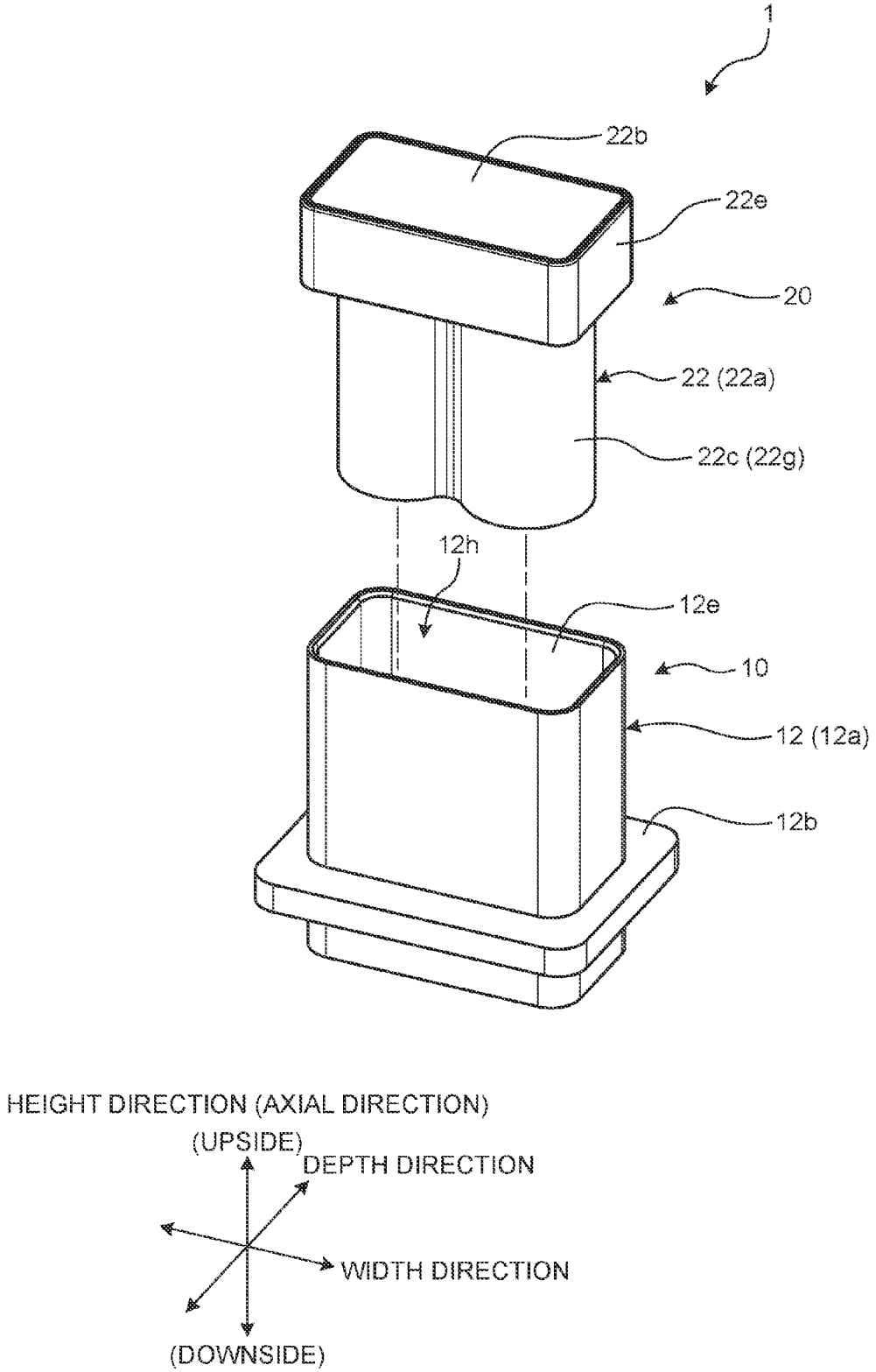
FIG. 1 is an exploded perspective view illustrating a configuration example of a service plug according to an embodiment.
Figure 2:
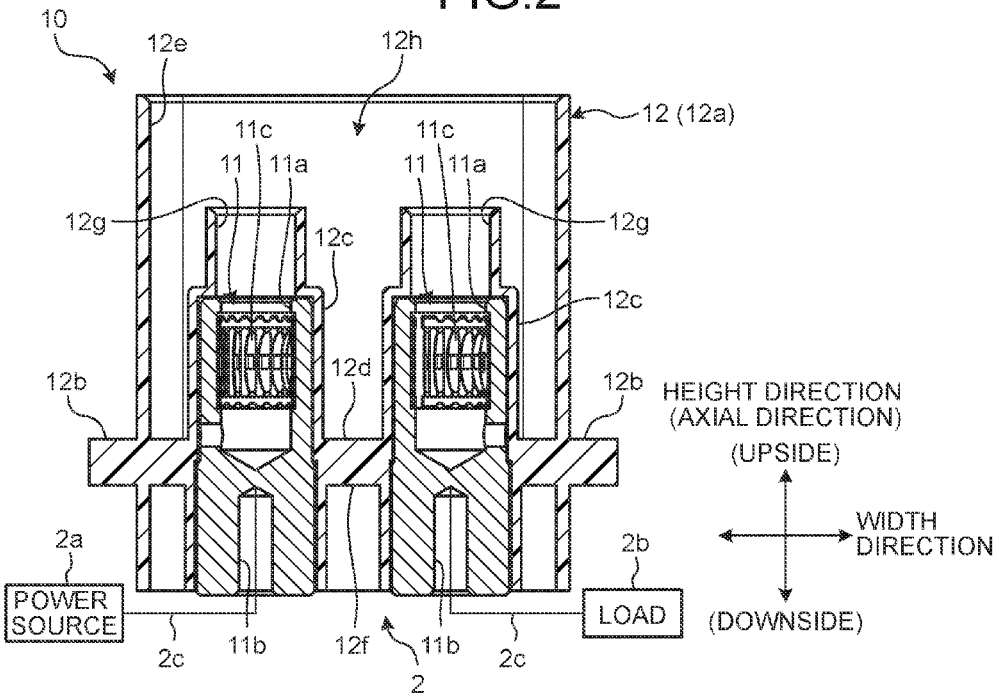
FIG. 2 is a cross-sectional view illustrating a configuration example of a receptacle connector according to the embodiment.

A plug connector and a power circuit cut-off device according to an embodiment will be described. In the present embodiment, as illustrated in FIG. 1, a service plug 1 serving as the power circuit cut-off device will be described by way of example. The service plug 1 is mounted on a vehicle such as an electric vehicle, a fuel cell vehicle, or a hybrid vehicle (not illustrated), and constitutes a part of a power circuit 2 for supplying electric power from a power source 2*a* such as a battery to a load 2*b* such as a rotary electric machine as illustrated in FIG. 2 to connect (electrically conduct or release disconnection) or disconnect the power circuit 2 as necessary. For example, during a work such as maintenance, the power circuit 2 is disconnected by this service plug 1 into a non-conduction state in order to secure safety of an operator by preventing an electric shock.

The service plug 1 has a receptacle connector 10 and a plug connector 20. In the service plug 1, the plug connector 20 is engaged with the receptacle connector 10 to electrically conduct the power circuit 2. In addition, the plug connector 20 is disengaged from the receptacle connector 10 to disconnect the power circuit 2.

In the following description, a direction of linking the receptacle connector 10 and the plug connector 20 (vertical direction in FIG. 1) will be referred to as a "height direction." The side where the plug connector 20 is located will be referred to as an "upside," and the side where the receptacle connector 10 is located will be referred to as a "downside." In addition, a direction into which the plug connector 20 is engaged with the receptacle connector 10, that is, a downward direction of the height direction will also be referred to as an "engagement direction." In addition, the height direction may also be referred to as an "axial direction." Furthermore, a direction perpendicular to the height direction, in which a plurality of plug terminals 21*a* are arranged, will be referred to as a "width direction." Note that the width direction includes a direction intersecting with the height direction. A direction perpendicular to the width direction and the height direction will be referred to as a "depth direction."

As illustrated in FIG. 2, the receptacle connector 10 has a receptacle terminal 11 and a receptacle housing 12. The receptacle terminal 11 constitutes a part of the power circuit 2 along with a plug terminal unit 21 described below. The receptacle terminal 11 is a female terminal and is formed of a conductive member such as metal. A plurality of receptacle terminals 11, for example, two receptacle terminals 11 are provided. Each receptacle terminal 11 is formed in a tubular shape and is fixed to the receptacle housing 12 in the height direction. Each receptacle terminal 11 has a plug terminal insertion portion 11*a* and a lead portion 11*b*. The plug terminal insertion portion 11*a* is a portion where the plug terminal 21*a* is inserted, and is provided in an upper part in the height direction. The plug terminal insertion portion 11*a* has a tubular electrode member 11*c* formed of a plurality of spring members. The electrode member 11*c* is mounted along a circumferential surface of the plug terminal insertion portion 11*a*. When the plug terminal 21*a* is inserted into the plug terminal insertion portion 11*a*, the electrode member 11*c* abuts on the plug terminal 21*a* to electrically connect the plug terminal 21*a* and the receptacle terminal 11 to each other. The lead portion 11*b* is provided in a lower part of the height direction and is connected to the power source 2*a* or the load 2*b* of the power circuit 2 through the electric cable 2*c*. For example, one of the lead portions 11*b* of the receptacle terminal 11 is connected to the power source 2*a* of the power circuit 2 through the electric cable 2*c*, and the other lead portion 11*b* of the receptacle terminal 11 is connected to the load 2*b* of the power circuit 2 through the electric cable 2*c*.

The receptacle housing 12 is formed of an insulation member such as resin through injection molding to insulatively hold the receptacle terminal 11. The receptacle housing 12 has a tubular receptacle-side outer wall portion 12*a*, a protrusion 12*b* protruding from the outer circumferential surface of the receptacle-side outer wall portion 12*a* in the width direction, a tubular holding portion 12*c* provided inside the receptacle-side outer wall portion 12*a* in a tubular shape to hold the receptacle terminal 11, and a fixing portion 12*d* provided to fix the tubular holding portion 12*c* inside the receptacle-side outer wall portion 12*a*.

The receptacle-side outer wall portion 12*a* is formed approximately in a rectangular shape as seen from the height direction and has four arc (rounded) corners. The receptacle-side outer wall portion 12*a* has an opening 12*e* opened in an upper part of the height direction, a blocked portion 12*f* blocked by the fixing portion 12*d* in a lower part of the height direction, and an engagement cavity portion 12*h* partitioned by the receptacle-side outer wall portion 12*a* and the blocked portion 12*f*. The protrusion 12*b* is used to fix the receptacle connector 10 to a vehicle and is formed, for example, in a ring shape along a circumferential direction of the outer circumferential surface of the receptacle-side outer wall portion 12*a*. The tubular holding portion 12*c* is formed in a cavity shape extending along the height direction. A plurality of, for example, two tubular holding portions 12*c* are arranged along the width direction where a plurality of plug terminals 21*a* described below are arranged. In the tubular holding portion 12*c*, an opening 12*g* is formed in a tubular shape where the plug terminal 21*a* is inserted or removed, and the plug terminal 21*a* is guided by the opening 12*g* to the receptacle terminal 11.

Figure 3:
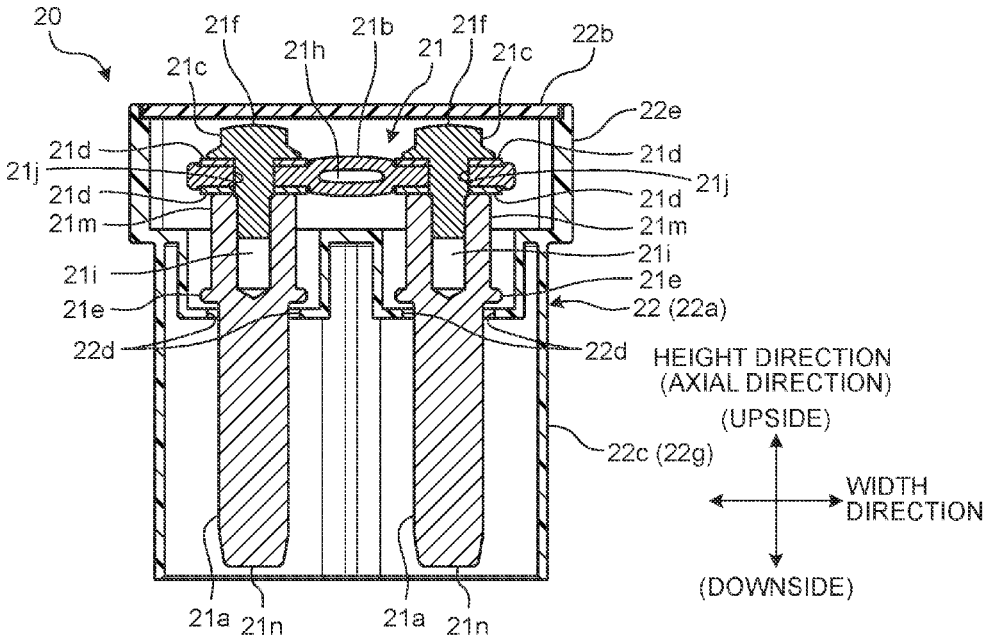
FIG. 3 is a cross-sectional view illustrating a configuration example of a plug connector according to the embodiment.
Figure 4:
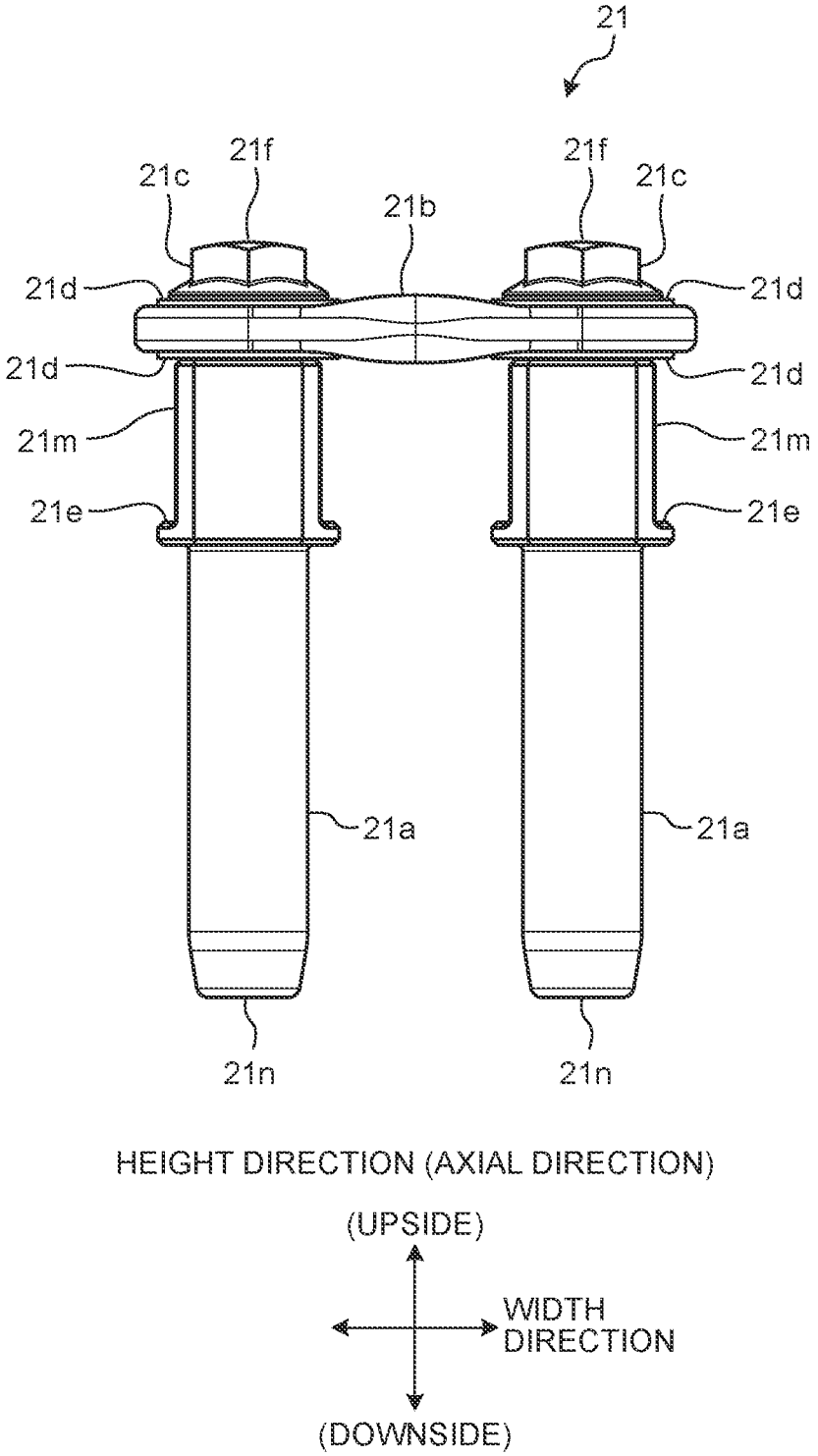
FIG. 4 is a front view illustrating a configuration example of a plug terminal unit according to the embodiment.

As illustrated in FIG. 3, the plug connector 20 has a plug terminal unit 21 and a plug housing 22 as a housing. As illustrated in FIG. 4, the plug terminal unit 21 has a plurality of plug terminals 21*a* and a braided wire 21*b* as a conductive wire member having flexibility higher than that of the plug housing 22. Each plug terminal 21*a* constitutes a part of the power circuit 2 along with the receptacle terminal 11. Each plug terminal 21*a* is a male terminal and is formed of a conductive member such as metal. Each plug terminal 21*a* is formed in a bar shape, and a plurality of, for example, two plug terminals 21*a* are provided. Each plug terminal 21*a* has the same length in the height direction and is connected to each other through the braided wire 21*b* to form the plug terminal unit 21. Each plug terminal 21*a* has a threaded hole 21*i* where a bolt 21*c* is fastened and is provided in an end 21*m* opposite to a contact point with the receptacle terminal 11. Each plug terminal 21*a* has an annular protrusion 21*e* abutting on a regulating portion 22*d* described below from the upside in the axial direction. In each plug terminal 21*a*, an end 21*n* in the side of the contact point with the receptacle terminal 11 is inserted into or removed from the receptacle terminal 11 along the axial direction (height direction).

The braided wire 21*b* is used to connect the ends 21*m* opposite to the contact points between each plug terminal 21*a* and the receptacle terminal 11. The braided wire 21*b* is formed, for example, by braiding a plurality of metal wires and has a long plate shape as seen from the height direction. The braided wire 21*b* has a cavity portion 21*h* formed in a cavity shape in the center of the width direction between each plug terminal 21*a*. The braided wire 21*b* has holes 21*j* in both ends where the bolts 21*c* are inserted. The bolts 21*c* are fastened to the holes 21*j* of both ends along with the threaded holes 21*i* of each plug terminal 21*a* to connect each plug terminal 21*a*. In this case, the braided wire 21*b* is fixed by fastening the bolts 21*c* to the threaded holes 21*i* of each plug terminal 21*a* by interposing washers 21*d*. The bolt 21*c* has a head portion 21*f* having an upper part of the height direction formed in a spherical surface shape, so that the head portion 21*f* abuts on the inner side of the plug housing 22 when each plug terminal 21*a* is inserted into each receptacle terminal 11. The plug terminal unit 21 constitutes a part of the power circuit 2 for supplying electric power from the power source 2*a* to the load 2*b* along with the receptacle terminal 11 and electrically conducts the power circuit 2 while it is connected to the receptacle terminal 11.

The plug housing 22 insulatively holds the plug terminal unit 21. The plug housing 22 is engaged with an engagement cavity portion 12*h* of the receptacle housing 12 or is disengaged from the engagement cavity portion 12*h*. The plug housing 22 has a housing body 22*a* and a lid portion 22*b*. The housing body 22*a* is formed of, for example, an insulation member such as resin through injection-molding and has a tubular plug-side outer wall portion 22*c* and a regulating portion 22*d*.

The tubular plug-side outer wall portion 22*c* forms an outer wall of the housing body 22*a* and has an exposed portion 22*e* gripped by an operator and a plug engagement wall 22*g* where the receptacle housing 12 is engaged. The exposed portion 22*e* is a portion where the plug housing 22 is exposed while it is engaged with the engagement cavity portion 12*h* of the receptacle housing 12. When seen from the height direction, the exposed portion 22*e* is formed in an approximately rectangular shape having four arc (rounded) corners and is larger than the opening 12*e* of the receptacle housing 12. The plug engagement wall 22*g* extends from the lower side of the height direction of the exposed portion 22*e*. When seen from the height direction, the plug engagement wall 22*g* is smaller than the opening 12*e* of the receptacle housing 12 and is formed in a shape that can be engaged with the inside of the receptacle-side outer wall portion 12*a* of the receptacle housing 12. In order to facilitate engagement with the receptacle-side outer wall portion 12*a*, the plug engagement wall 22*g* has a gap from the inside of the receptacle-side outer wall portion 12*a*. The length of the height direction of the plug engagement wall 22*g* is approximately equal to a length from the opening 12*e* of the receptacle-side outer wall portion 12*a* to the fixing portion 12*d* of the receptacle-side outer wall portion 12*a*. As a result, the plug-side outer wall portion 22*c* is engaged with the engagement cavity portion 12*h* until the plug engagement wall 22*g* abuts on the fixing portion 12*d* of the receptacle-side outer wall portion 12*a*, or the lower side of the height direction of the exposed portion 22*e* abuts on the opening 12*e* of the receptacle-side outer wall portion 12*a*.

The regulating portion 22*d* is provided inside the plug-side outer wall portion 22*c* to restrict a movement of the plug terminal unit 21. The regulating portion 22*d* is formed in a ring shape to surround a part of the circumferential surface of each plug terminal 21*a*. As a result, when the plug terminal unit 21 moves in a direction perpendicular to the axial direction of the plug terminal unit 21, for example, in the width direction or the depth direction, the regulating portion 22*d* abuts on the circumferential surface of each plug terminal 21*a* to restrict a movement of each plug terminal 21*a*. In addition, the protrusion 21*e* of each plug terminal 21*a* abuts on the regulating portion 22*d* from the upper side in the axial direction. As a result, when the plug terminal unit 21 moves to the lower side of the axial direction, the regulating portion 22*d* abuts on the protrusion 21*e* of each plug terminal 21*a* to restrict the movement of each plug terminal 21*a* with in predetermined position.

The lid portion 22*b* blocks an upper opening of the height direction of the tubular housing body 22*a*. The lid portion 22*b* is formed of an insulation member such as resin through injection molding. The lid portion 22*b* is formed in a flat plate shape and is installed in the upper opening of the height direction of the housing body 22*a*, that is, in the opening of the exposed portion 22*e*. The lid portion 22*b* restricts the upward movement of the plug terminal unit 21 in the axial direction. When the plug terminal unit 21 moves upward in the axial direction, the bolt 21*c* of the plug terminal unit 21 abuts on the lid portion 22*b*, so that the lid portion 22*b* restricts the movement of each plug terminal 21*a*.

Figure 5:
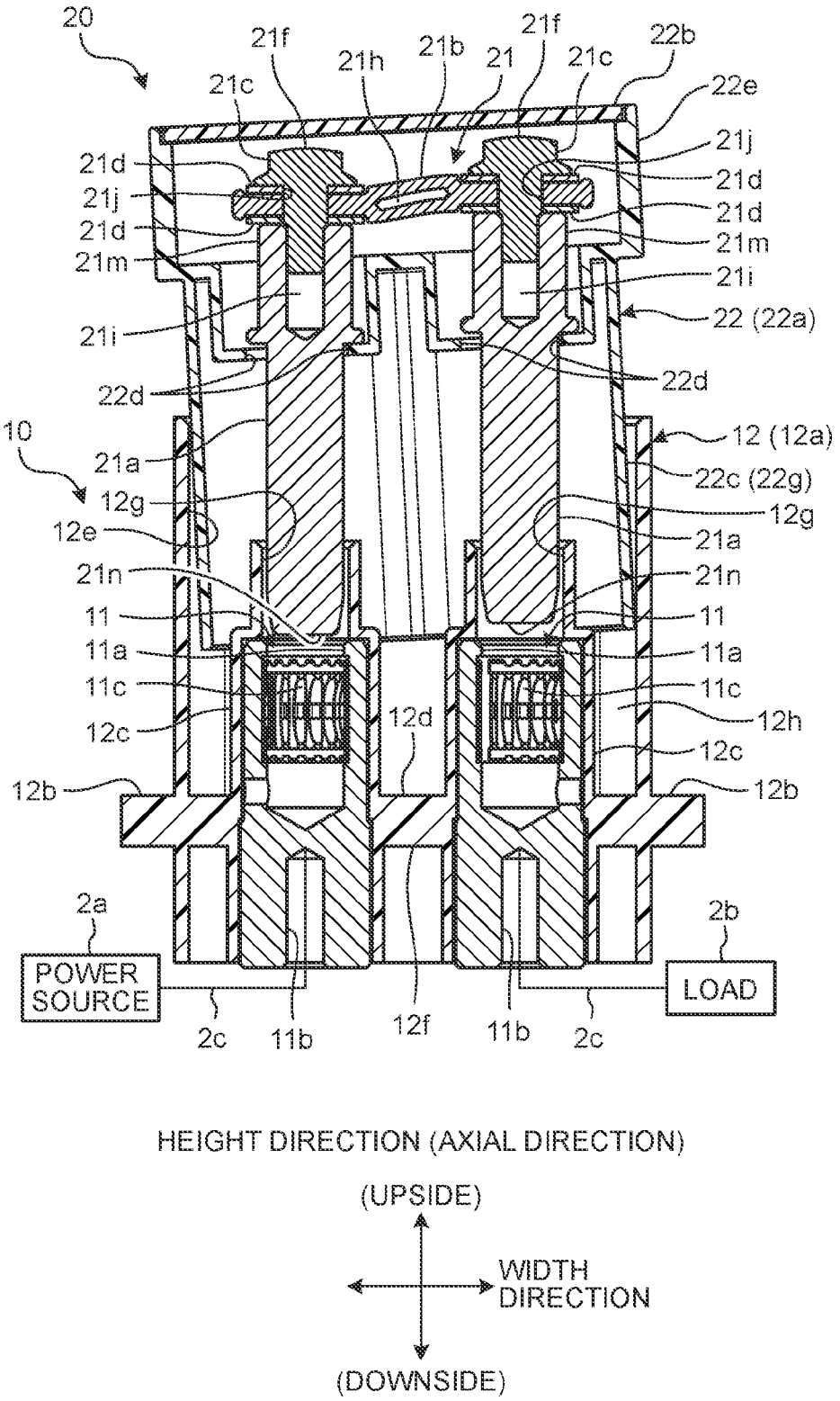
FIG. 5 is a cross-sectional view illustrating a function example of the plug connector according to the embodiment.
Figure 6:
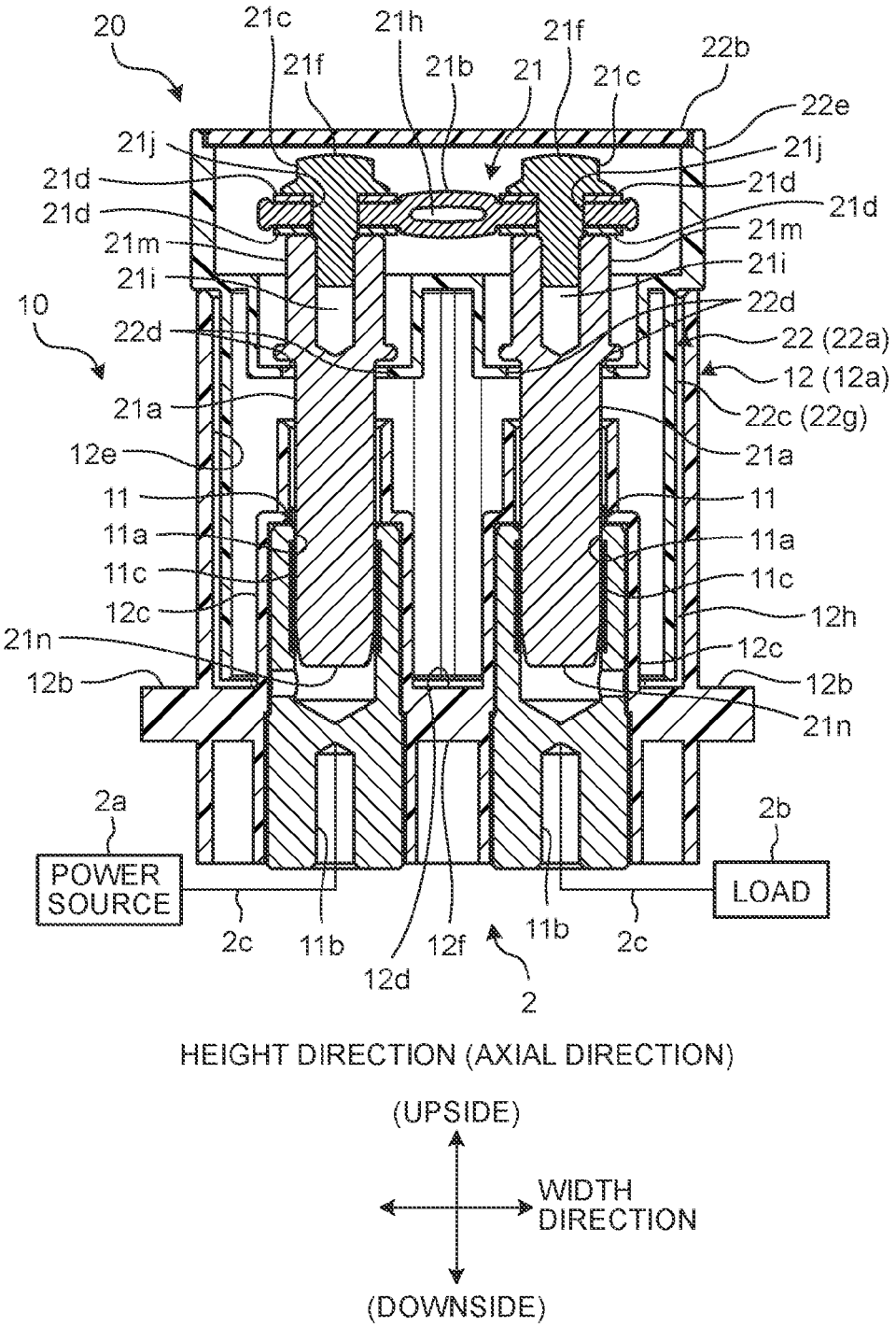
FIG. 6 is a cross-sectional view illustrating a function example of the plug connector according to the embodiment.

Next, functions of the plug connector 20 will be described. As illustrated in FIG. 5, the plug housing 22 of the plug connector 20 is engaged with the engagement cavity portion 12*h* of the receptacle housing 12. In some cases, the axial direction of the plug terminal 21*a* of the plug connector 20 may not be coaxial with the axial direction of the receptacle terminal 11 due to an engagement gap between the plug housing 22 and the receptacle housing 12. In this case, in the plug connector 20, when a lower end 21*n* of the height direction of the plug terminal 21*a* is inserted into the opening of the tubular holding portion 12*c* of the receptacle housing 12, the braided wire 21*b* is contracted in the width direction or is bent in the height direction, so that the plug terminals 21*a* move relatively to each other, and the plug terminal 21*a* and the receptacle terminal 11 are placed coaxially. In addition, the plug connector 20 is pushed in the engagement direction to insert the plug terminal 21*a* into the receptacle terminal 11 while the plug terminal 21*a* and the receptacle terminal 11 are placed coaxially, and the head portion 21*f* of the bolt 21*c* of the plug terminal unit 21 abuts on the lower side of the height direction of the lid portion 22*b*. As a result, in the plug connector 20, even when the axial direction of the plug terminal 21*a* is not coaxial with the axial direction of the receptacle terminal 11 during engagement, each plug terminal 21*a* moves relatively, and the plug terminal 21*a* and the receptacle terminal 11 are placed coaxially, so that the plug terminal 21*a* is smoothly inserted into the receptacle terminal 11. As illustrated in FIG. 6, in the plug connector 20, the plug terminal 21*a* is inserted into the receptacle terminal 11 and abuts on the electrode member 11*c* of the receptacle terminal 11, so that the plug terminal 21*a* and the receptacle terminal 11 are electrically connected to each other. As a result, the plug connector 20 electrically conducts the power circuit 2 along with the receptacle connector 10, so that an electric current can flow from the power source 2*a* to the load 2*b*.

When the plug connector 20 is disengaged from the receptacle connector 10, for example, due to the engagement gap between the plug housing 22 and the receptacle housing 12, the plug housing 22 may be disengaged in a sloped direction intersecting with the height direction with respect to the receptacle housing 12. In this case, in the plug connector 20, while the plug terminal 21*a* is inserted into the receptacle terminal 11, the plug housing 22 is pivoted against the plug terminal unit 21. That is, in the plug connector 20, even when the plug housing 22 is disengaged in a sloped direction with respect to the receptacle housing 12, only the plug housing 22 is pivoted, so that the plug connector 20 is disengaged from the receptacle connector 10 while the plug terminal 21*a* and the receptacle terminal 11 are placed coaxially. As a result, in the plug connector 20, even when the plug housing 22 is disengaged in a sloped direction with respect to the receptacle housing 12 during disengagement, the plug terminal 21*a* is smoothly removed from the receptacle terminal 11.

As described above, the plug connector 20 according to the embodiment is installed in the plug housing 22 and has the conductive braided wire 21*b* that connects the ends 21*m* of a plurality of plug terminals 21*a* opposite to the contact points with the receptacle terminals 11 such that each plug terminal 21*a* can move relatively to each other. In addition, the service plug 1 has the plug connector 20 and the receptacle connector 10. As a result, the axial direction of the plug terminal 21*a* is placed coaxially with the axial direction of the receptacle terminal 11 by relatively moving each plug terminal 21*a* during engagement between the plug connector 20 and the service plug 1, and a contact pressure between the plug terminal 21*a* and the receptacle terminal 11 is suppressed to a lower value. Therefore, it is possible to smoothly insert the plug terminal 21*a* to the receptacle terminal 11. In addition, the plug housing 22 moves relatively to the plug terminal unit 21 during disengagement between the plug connector 20 and the service plug 1, so that the plug terminal 21*a* can be smoothly removed from the receptacle terminal 11 while the plug terminal 21*a* and the receptacle terminal 11 are placed coaxially. In addition, in the plug connector 20 and the service plug 1, since the plug terminal unit 21 is not fixed to the plug housing 22 unlike the background art, it is possible to prevent insertion or removal while the plug terminal 21*a* is not placed coaxially with the receptacle terminal 11 due to an assembly error of the plug terminal unit 21. Furthermore, in the plug connector 20 and the service plug 1, since each plug terminal 21*a* is not connected to each other using a rigid member unlike the background art, it is possible to prevent each plug terminal 21*a* from being fixed with a different axial direction or prevent each plug terminal 21*a* from being fixed while each plug terminal 21*a* has a pitch of the width direction different from that of each receptacle terminal 11.

The braided wire 21*b* is formed by braiding a plurality of metal wires. As a result, the braided wire 21*b* is extended, contracted, or bent when the plug terminal 21*a* is inserted into or removed from the receptacle terminal 11 to relatively move each plug terminal 21*a* and coaxially place the plug terminal 21*a* and the receptacle terminal 11.

In the plug terminal unit 21, the head portion 21*f* of the bolt 21*c* is formed in a spherical surface shape, and the head portion 21*f* abuts on the inside of the plug housing 22 when the plug terminal 21*a* is inserted into the receptacle terminal 11. As a result, in the plug terminal unit 21, the head portion 21*f* of the bolt 21*c* can reduce resistance between the head portion 21*f* and the plug housing 22 caused by the slope of the bolt 21*c*, compared to a case where the head portion 21*f* has a flat shape. Therefore, in the plug terminal unit 21, the plug terminal 21*a* can be pushed into the receptacle terminal 11 while the plug terminal 21*a* and the receptacle terminal 11 are placed coaxially.

Modification

Figure 7:
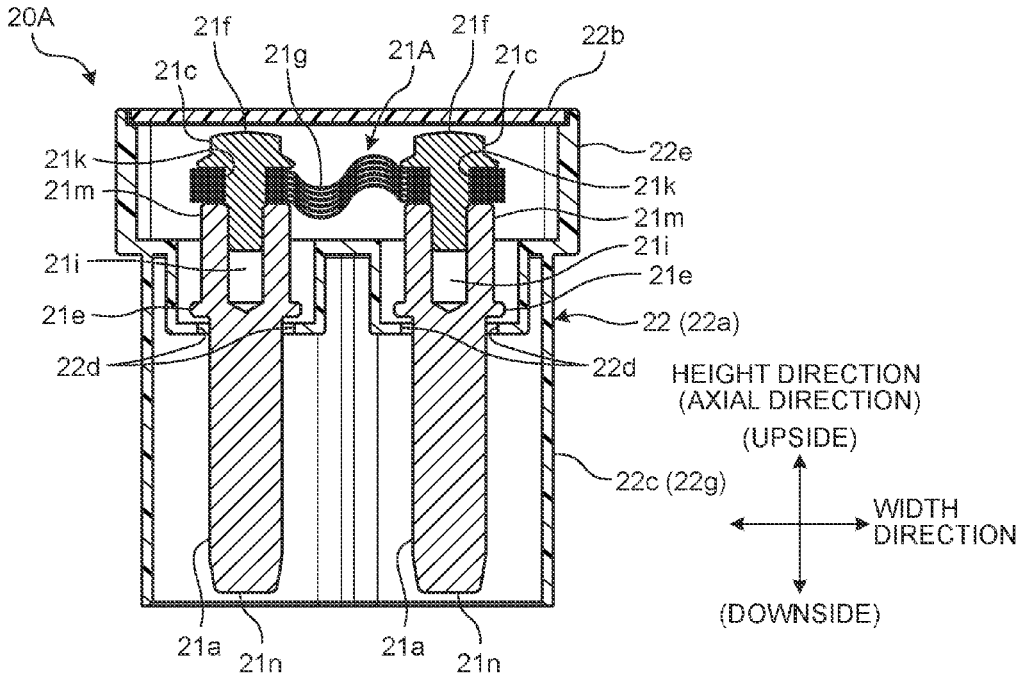
FIG. 7 is a cross-sectional view illustrating a configuration example of a plug connector according to a modification.
Figure 8:
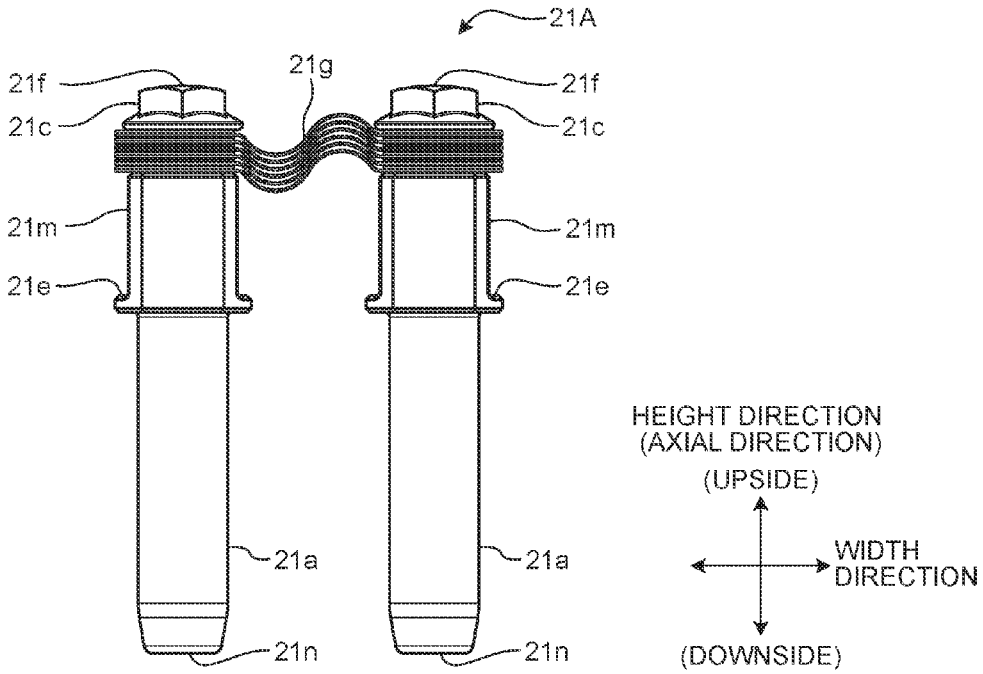
FIG. 8 is a front view illustrating a configuration example of the plug connector according to the modification.

Next, a modification of the plug connector 20 according to the embodiment will be described. In the plug connector 20, the braided wire 21*b* is used to connect each plug terminal 21*a* by way of example. However, the present invention is not limited thereto. For example, as illustrated in FIGS. 7 and 8, in the plug connector 20A, a spring stack 21*g* connects ends 21*m* opposite to the contact points between each plug terminal 21*a* and the receptacle terminals 11. For example, the spring stack 21*g* is formed by stacking a plurality of metal plates with a gap and has a rectangular shape as seen from the height direction. When seen from the depth direction, a middle portion of the spring stack 21*g* is formed in an S-shape, and its both ends are formed in a flat shape. The spring stack 21*g* has holes 21*k* in both ends to receive the bolts 21*c*. The bolts 21*c* are fastened to the holes 21*k* of the spring stack 21*g* in both ends along with the threaded holes 21*i* of the plug terminal 21*a* to connect each plug terminal 21*a*.

Figure 9:
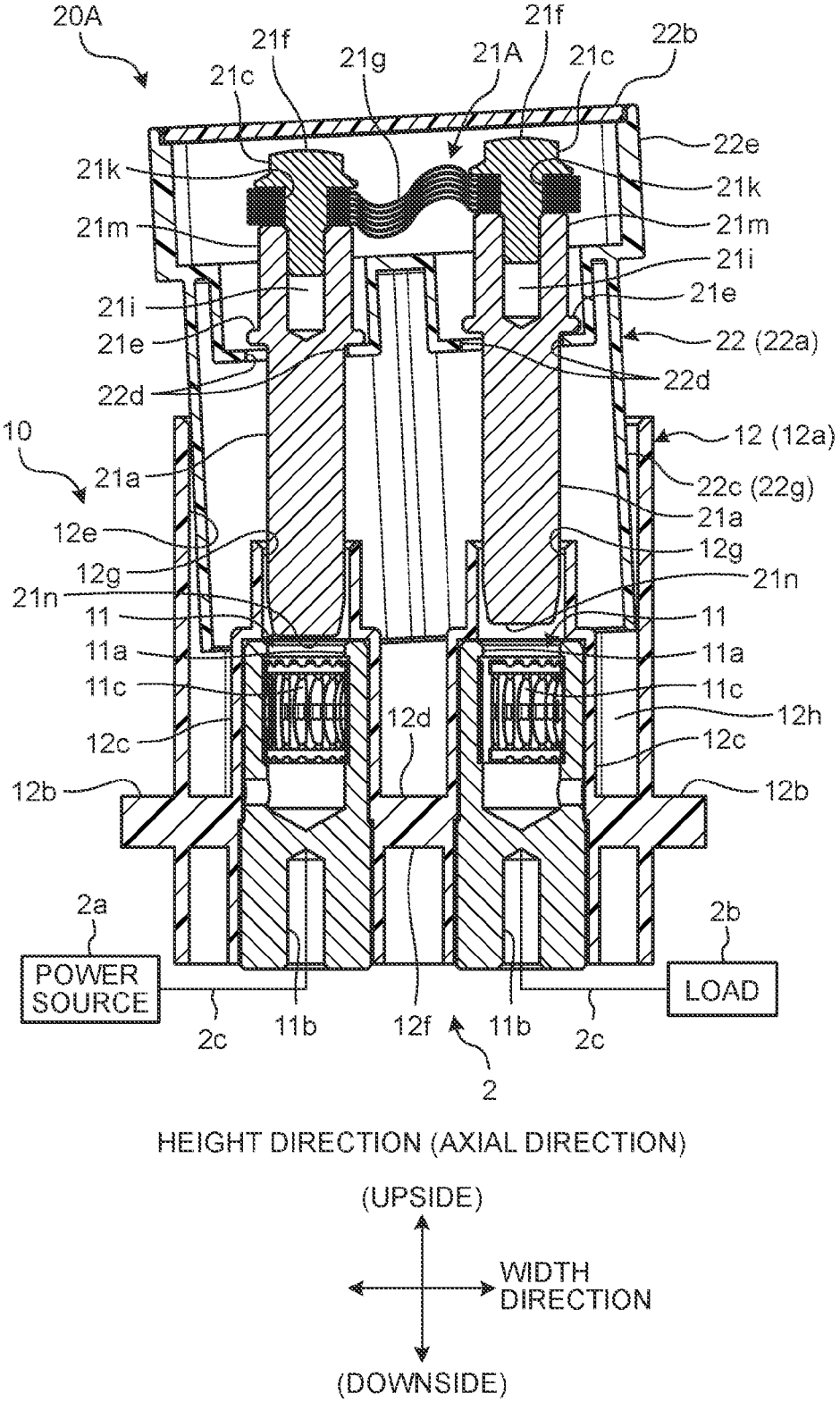
FIG. 9 is a cross-sectional view illustrating a function example of the plug connector according to the modification.

Next, functions of the plug connector 20A will be described. As illustrated in FIG. 9, in the plug connector 20A, the plug housing 22 is engaged with the engagement cavity portion 12*h* of the receptacle housing 12. In some cases, in the plug connector 20A, the axial direction of the plug terminal 21*a* may not be placed coaxially with the axial direction of the receptacle terminal 11 due to an engagement gap between the plug housing 22 and the receptacle housing 12. In this case, in the plug connector 20A, when the lower end 21*n* of the height direction of the plug terminal 21*a* is inserted into the opening 12*g* of the tubular holding portion 12*c* of the receptacle housing 12, the spring stack 21*g* is extended or contracted in the width direction or is bent in the height direction, so that each plug terminal 21*a* moves relatively to each other, and the plug terminal 21*a* and the receptacle terminal 11 are placed coaxially. In addition, the plug connector 20A is pushed in the engagement direction while the plug terminal 21*a* and the receptacle terminal 11 are placed coaxially, and the head portion 21*f* of the bolts 21*c* of the plug terminal unit 21A abuts on the lower side of the height direction of the lid portion 22*b*, so that the plug terminal 21*a* is inserted into the receptacle terminal 11. As a result, in the plug connector 20A, even when the axial direction of the plug terminal 21*a* is not placed coaxially with the axial direction of the receptacle terminal 11 during engagement, each plug terminal 21*a* moves relatively, and the plug terminal 21*a* and the receptacle terminal 11 are placed coaxially, so that the plug terminal 21*a* is smoothly inserted into the receptacle terminal 11.

In the plug connector 20A, when the receptacle connector 10 is disengaged, for example, due to the engagement gap between the plug housing 22 and the receptacle housing, the plug housing 22 may be disengaged in a sloped direction intersecting with the height direction with respect to the receptacle housing 12 in some cases. In this case, in the plug connector 20A, while the plug terminal 21*a* is inserted into the receptacle terminal 11, the plug housing 22 is pivoted with respect to the plug terminal unit 21A. That is, in the plug connector 20A, even when the plug housing 22 is disengaged in a sloped direction with respect to the receptacle housing 12, only the plug housing 22 is pivoted. Therefore, the plug housing 22 is disengaged from the receptacle connector 10 while the plug terminal 21*a* and the receptacle terminal 11 are placed coaxially. As a result, in the plug connector 20A, the plug terminal 21*a* is smoothly removed from the receptacle terminal 11 even when the plug housing 22 is disengaged in a sloped direction with respect to the receptacle housing 12 during disengagement.

As described above, in the plug connector 20A according to the modification, the spring stack 21*g* is formed by stacking a plurality of metal plates. As a result, in the plug connector 20A, the spring stack 21*g* is extend or contracted in the width direction or is bent in the height direction when the plug terminal 21*a* is inserted into or removed from the receptacle terminal 11, so that the plug terminal 21*a* and the receptacle terminal 11 can be placed coaxially by relatively moving each plug terminal 21*a*.

The service plug 1 may be a lever type connector having a lever pivotally provided in the plug housing 22 to exert an engagement of disengagement force between the plug housing 22 and the receptacle housing 12 through a pivoting control.

In the service plug 1, the plug terminal 21*a* is a male terminal, and the receptacle terminal 11 is a female terminal. However, the present embodiment is not limited thereto. For example, in the service plug 1, the plug terminal 21*a* may be a female terminal, and the receptacle terminal 11 may be a male terminal.

The plug connector and the power circuit cut-off device according to the present embodiment have the conductive wire member that connects the plug terminals such that each plug terminal can move relatively to each other. Therefore, it is possible to smoothly insert or remove the plug terminal and the receptacle terminal by relatively moving each plug terminal and coaxially placing the plug terminal and the receptacle terminal.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A plug connector comprising:

a housing configured to be engaged with or disengaged from a receptacle connector for performing electrical connection; and a plug terminal unit that is provided in the housing, and has a plurality of bar-shaped plug terminals configured to be inserted into or removed from receptacle terminals of the receptacle connector in an axial direction, and a conductive wire member within the housing, the conductive wire member that connects to each of ends of the plurality of plug terminals opposite to contact points with the receptacle terminals such that each plug terminal can move relatively to each other, wherein the plurality of plug terminals and the wire member constitute a part of a power circuit for supplying electric power from a power source to a load along with the receptacle terminals, and the plurality of plug terminals electrically conduct the power circuit while the plug terminals are connected to the receptacle terminals.

2. The plug connector according to claim 1, wherein the wire member is a braided wire formed by braiding a plurality of metal wires or a spring stack formed by stacking a plurality of metal plates.

3. The plug connector according to claim 1, wherein the plug terminal unit has a fastening member configured to fasten the ends opposite to contact points with the receptacle terminals to the wire member, a head portion of the fastening member is formed in a spherical surface shape, and the head portion of the fastening member abuts on an inside of the housing when the plug terminals are inserted into the receptacle terminals.

4. The plug connector according to claim 2, wherein the plug terminal unit has a fastening member configured to fasten the ends opposite to contact points with the receptacle terminals to the wire member, a head portion of the fastening member is formed in a spherical surface shape, and the head portion of the fastening member abuts on an inside of the housing when the plug terminals are inserted into the receptacle terminals.

5. A power circuit cut-off device comprising:

a receptacle connector having a receptacle terminal for performing electrical connection; and a plug connector having a housing engaged with or disengaged with the receptacle connector, and a plug terminal unit that is provided in the housing and has a plurality of bar-shaped plug terminals inserted into or removed from receptacle terminals of the receptacle connector in an axial direction, and a conductive wire member within the housing, the conductive wire member that connects to each of ends of the plurality of plug terminals opposite to contact points with the receptacle terminals such that each plug terminal can move relatively to each other, wherein the plurality of plug terminals and the wire member constitute a part of a power circuit for supplying electric power from a power source to a load along with the receptacle terminals, and the plurality of plug terminals electrically conduct the power circuit while the plug terminals are connected to the receptacle terminals.

6. The plug connector according to claim 1, wherein the plug terminal unit is contained within the housing, and the conductive wire member connects to each of the ends of the plurality of plug terminals opposite to the contact points such that the plurality of plug terminals are movable within the housing.

* * * * *